US011219793B1

(12) United States Patent
Weiss

(10) Patent No.: US 11,219,793 B1
(45) Date of Patent: Jan. 11, 2022

(54) ELBOW PLANCHE SUPPORT

(71) Applicant: Jared Weiss, Waterford, CT (US)

(72) Inventor: Jared Weiss, Waterford, CT (US)

( * ) Notice: Subject to any disclaimer, the term of this patent is extended or adjusted under 35 U.S.C. 154(b) by 43 days.

(21) Appl. No.: 16/790,994

(22) Filed: Feb. 14, 2020

Related U.S. Application Data

(60) Provisional application No. 62/807,093, filed on Feb. 18, 2019.

(51) Int. Cl.
*A63B 23/12* (2006.01)
*A63B 21/00* (2006.01)

(52) U.S. Cl.
CPC .... *A63B 21/00047* (2013.01); *A63B 23/1236* (2013.01); *A63B 21/4033* (2015.10); *A63B 2210/50* (2013.01)

(58) Field of Classification Search
CPC ..... A63B 21/00047; A63B 21/0005; A63B 21/00054; A63B 21/068; A63B 21/4033; A63B 21/4034; A63B 21/4035; A63B 21/4039; A63B 21/4047; A63B 23/1209; A63B 23/1218; A63B 23/1227; A63B 23/1236; A63B 23/1245; A63B 9/00; A63B 3/00; A63B 1/00; A63B 2009/006; A63B 17/00; A63B 17/02; A63B 17/04; A61H 3/00; B62H 3/04; B62H 3/06; B62H 3/08; B62H 3/10
See application file for complete search history.

(56) References Cited

U.S. PATENT DOCUMENTS

| | | | | |
|---|---|---|---|---|
| 3,679,203 | A * | 7/1972 | Grana | A63B 21/00054 482/142 |
| 5,536,223 | A | 7/1996 | Ferber | |
| 5,697,875 | A | 12/1997 | Stan | |
| 6,082,384 | A * | 7/2000 | Cheng | A61H 3/00 135/66 |
| 7,147,591 | B2 | 12/2006 | McAvoy | |
| 7,364,530 | B2 | 4/2008 | Lopez | |
| 7,662,067 | B2 * | 2/2010 | Payne | A63B 21/00047 482/38 |
| 2005/0209054 | A1 | 9/2005 | Lebert | |
| 2009/0124471 | A1 * | 5/2009 | Storch | A63B 21/4035 482/141 |
| 2013/0324383 | A1 * | 12/2013 | Rogers | A63B 23/1218 482/142 |
| 2016/0074693 | A1 * | 3/2016 | Henry | A63B 21/4033 482/141 |
| 2017/0274245 | A1 | 9/2017 | Cambridge | |

FOREIGN PATENT DOCUMENTS

| | | | |
|---|---|---|---|
| KR | 20180018191 | A | 2/2018 |

* cited by examiner

*Primary Examiner* — Nyca T Nguyen
*Assistant Examiner* — Zachary T Moore
(74) *Attorney, Agent, or Firm* — Werschulz Patent Law, LLC; Patricia P. Werschulz, Esq.

(57) ABSTRACT

A portable exercise device for performing an elbow planche and other gymnastics and calisthenics holding poses. The portable elbow planche support has a pair of geometrical structures connected with articulating joints, supported by a plurality of feet. In one example embodiment, the geometrical structures are trapezoids. The elbow planche support is selectively assembled and disassembled, the feet and the articulating joints are removable for ease of storage, and the elbow planche support folds. In another example embodiment, the elbow planche support is a unitary device.

12 Claims, 9 Drawing Sheets

ELBOW PLANCHE SUPPORT

CROSS-REFERENCE TO RELATED APPLICATIONS

This application is a nonprovisional utility application of the provisional patent application, Ser. No. 62/807,093, filed in the United States Patent Office on Feb. 18, 2019, and claims the priority thereof and is expressly incorporated herein by reference in its entirety.

TECHNICAL FIELD

The present disclosure relates generally to an exercise device. More particularly, the present disclosure relates to a portable exercise device for performing an elbow planche and other gymnastics and calisthenics holding poses.

BACKGROUND

A planche is a bodyweight exercise in calisthenics and gymnastics in which the user's body is parallel to the ground, the body being supported only by the user's arms while the user holds the position for an extended period. By holding the pose, the user develops core and upper body strength, coordination, balance and stability.

While the exercise can be performed on the floor or a flat surface, the use of hex dumbbells as parallel bars can be implemented, allowing for a less strenuous wrist geometry by having the user grip the bars. The exercise can be further enhanced by performing the exercise on a single or double stationary bar, such as a ballet bar or a railing, raising the point of support higher off the ground than an unassisted exercise or using hex dumbbells.

A common and more mobile alternative to stationary parallel bars are stand-alone exercise bars. A planche could be performed using one or a pair of such a device, with the pair having more stability. These mobile alternatives, commonly known as parallettes, are often made from iron or PVC piping and T-connectors. Unfortunately, mobile parallettes lack the stability of stationary parallel bars, and have to be disassembled to be easily transported or stored.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an elbow planche support for performing elbow planche exercises and other gymnastics and calisthenics holding pose. Accordingly, an aspect of an example embodiment in the present disclosure provides an elbow planche support comprising two geometrical structures at an angle to one another, connected by joints. The two geometrical structures being supported upright by a plurality of removable feet at the base of the geometrical structures, the feet being perpendicular to the geometrical structures. In the preferred embodiment, the geometrical structures are trapezoidal.

Another aspect of an example embodiment in the present disclosure is to provide an elbow planche support that is balanced. Accordingly, another aspect of an example embodiment in the present disclosure is an elbow planche support that has a pair of trapezoids at a right angle, a user balancing over the right angle at the user's center of gravity.

Yet another aspect of an example embodiment in the present disclosure is to provide an elbow planche support that is foldable for ease of storage. Accordingly, the present disclosure provides means of disassembly of the two geometrical structures at the joints and at the feet of the base.

A further aspect of an example embodiment in the present disclosure is to provide a means of storing the disassembled removable feet.

A final aspect of an example embodiment in the present disclosure is to provide a method of assembly of an elbow planche support that is foldable for ease of storage The present disclosure addresses at least one of the disadvantages of the prior art. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
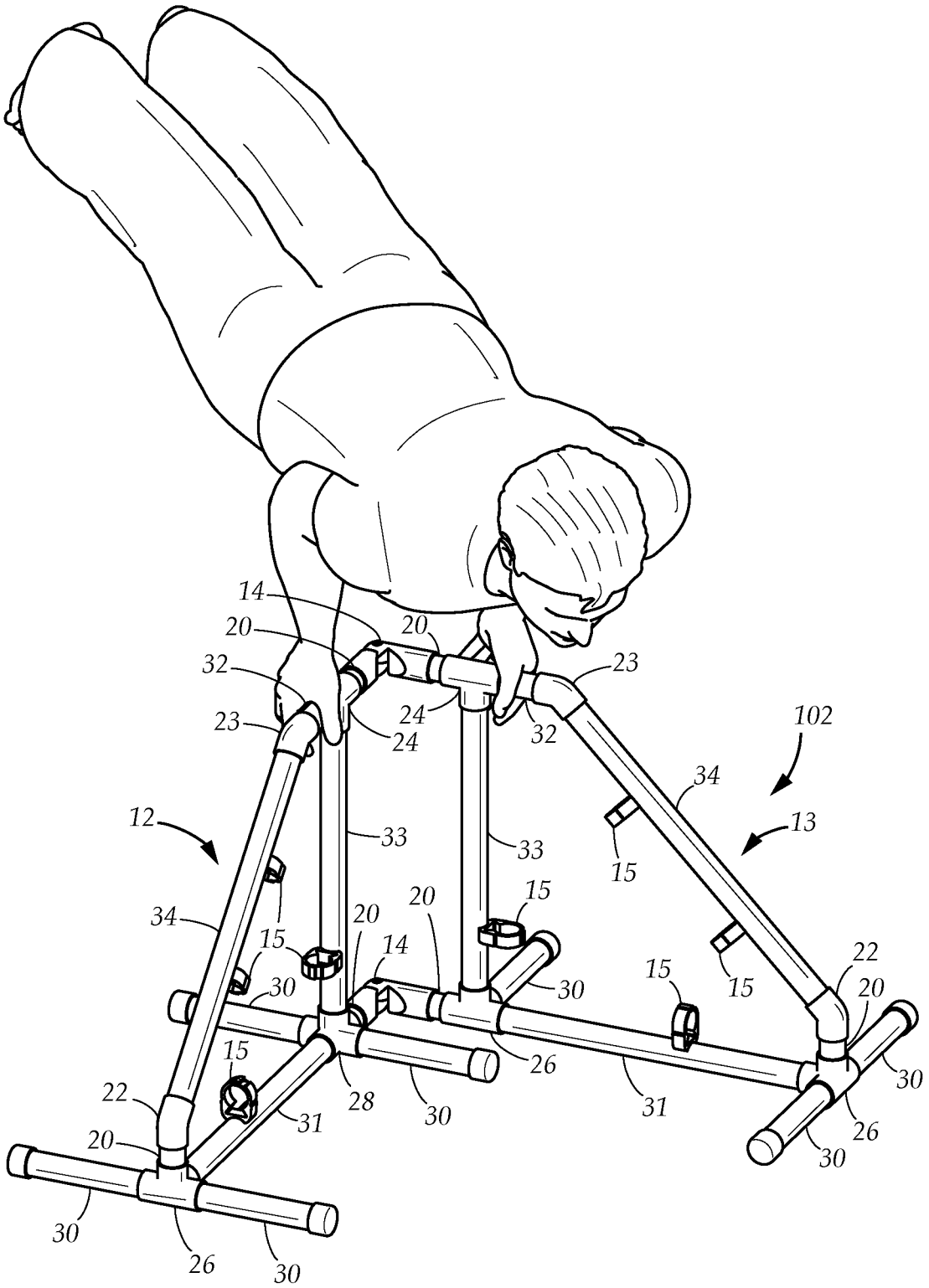
FIG. 1 is a perspective view of an example embodiment of an elbow planche support in use.

Referring to FIG. 1, the preferred example embodiment of an elbow planche support 102 in use is shown. The elbow planche support 102 is easily assembled as explained hereinbelow. The elbow planche support 102 comprises of two geometrical supports 12 and 13 each having a trapezoid and hereafter referred to as the trapezoids 12, 13 removably connected with at least two articulating elbow joints 14.

Each trapezoid 12, 13 comprises a plurality of straight sections 31, 32, 33, 34. Each trapezoid 12, 13 is a right trapezoid, having a short top base 32, a long bottom base 31, a vertical leg 33 and a second leg 34. The straight sections 31, 32, 33, 34 connected by a plurality of couplers 20, a plurality of angled joints 22, 23, a T-joint 24, a four-way joint 26, a five-way joint 28 and a plurality of feet 30. Each trapezoid 12, 13 defines a plane. The feet 30 are orthogonally connected to the long bottom bases 31 of the trapezoids 12, 13.

In the preferred embodiment, the straight sections 31, 32, 33, 34 and the couplers 20 may be received or press-fit into the joints.

The articulating elbow joints 14 have two connections in the x- and y-plane at an angle to one another. The articulating elbow joints 14 preferably rotate from a right angle to a straight line when in use, but can rotate to an acute angle for storage. The T-joint 24 has three connection points at right angles to one another in the x- and y-planes. The four-way joint 26 has three connection points at right angles to one another in the x- and y- planes, and one connection point in the z-plane the z-plane connection point being at a right angle to the x- and y-planes. The five-way joint 28 has four connection points at right angles to one another in the x-and y-planes, and one connection point in the z-plane, the z-plane connection point being at a right angle to the x- and y-planes.

Referring to each trapezoid 12, 13, the long base 31 is connected to the second leg 34 with a four-way joint 26 connected to a first coupler 20 and a first angled joint 22. The second leg 34 is connected to the short base 32 with a second angled joint 23. The short base 32 is connected to the first leg 33 with the T-joint 24, and the first leg 33 is connected to the long base 31 with the four-way joint 26.

The T-joint 24 is connected to a first articulating elbow joint 14 with a second coupler 20, the five-way joint 28 is connected to a second articulating elbow joint 14 with a third coupler 20. The first and second joints 14 rotate perpendicular to the plane of each trapezoid.

In the preferred embodiment, the first trapezoid 12 comprises four feet 30, two feet 30 connecting to the five-way joint 28 and two feet connecting to the four-way joint 26. Described differently, the first trapezoid 12 has an inner side with a pair of feet 30 and an outer side with a pair of feet 30. The second trapezoid 12 comprises three feet 30, two feet 30 connecting to the five-way joint 28 and one foot 30 connecting to a four-way joint 26 in lieu of the five-way joint 24. Described differently, the second trapezoid 13 has an inner side with a pair of feet 30 and an outer side with at least one foot 30.

In FIG. 1, the first trapezoid 12 with two pairs of feet 30 is shown on the left and the second trapezoid 13 with a pair of feet 30 and at least one foot 30 is shown on the right. It is understood by those of ordinary skill in the art that the first trapezoid 12 can be on the right and the second trapezoid 13 on the left within the inventive concept.

The user grips both of the user's hands onto the short base 32 of the pair of trapezoid 12, 13 respectively. The user is then able to perform the exercise, the center of mass of the user being balanced over the elbow planche support 102.

The elbow planche support 102 is selectively assembled and disassembled. Each trapezoid 12, 13 shown in FIGS. 1, 3-7 may be fully or partially disassembled, having removable couplers 20 at the articulating elbow joints 14 for ease of storage. Each individual joint previously described may be press-fit into one another, and each joint may be fully or partially disassembled. The preferred embodiment may be fully folded after removing the feet 30 and decoupling the couplers 20 at the articulating joints 14 for ease of storage.

Figure 7:
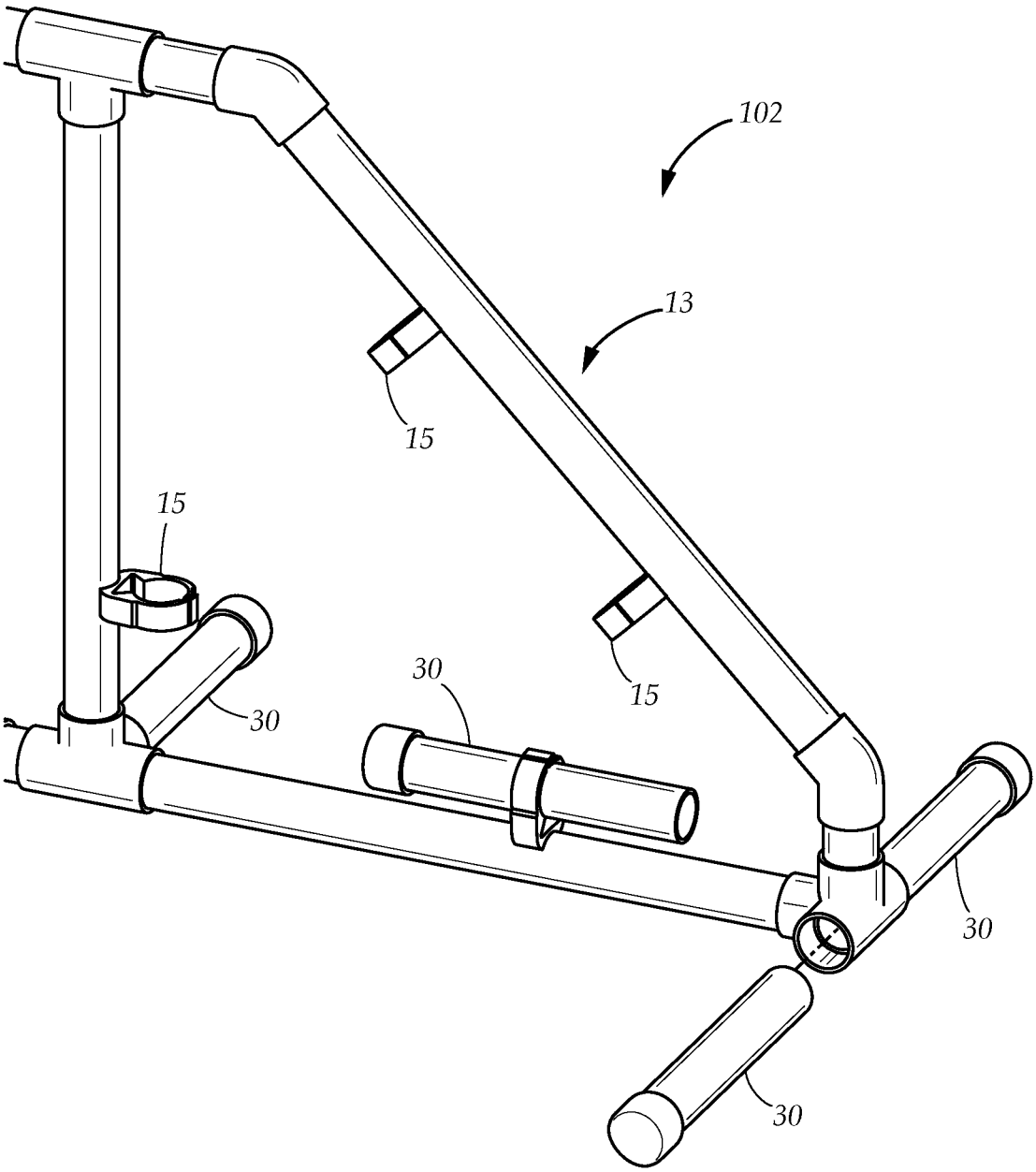
FIG. 7 is a detailed perspective view of feet holders of an example embodiment of an elbow planche support.

As shown in FIG. 7, the preferred embodiment further comprises of feet holders 15, which are configured to store the removable feet 30 for ease of storage.

Figure 2:
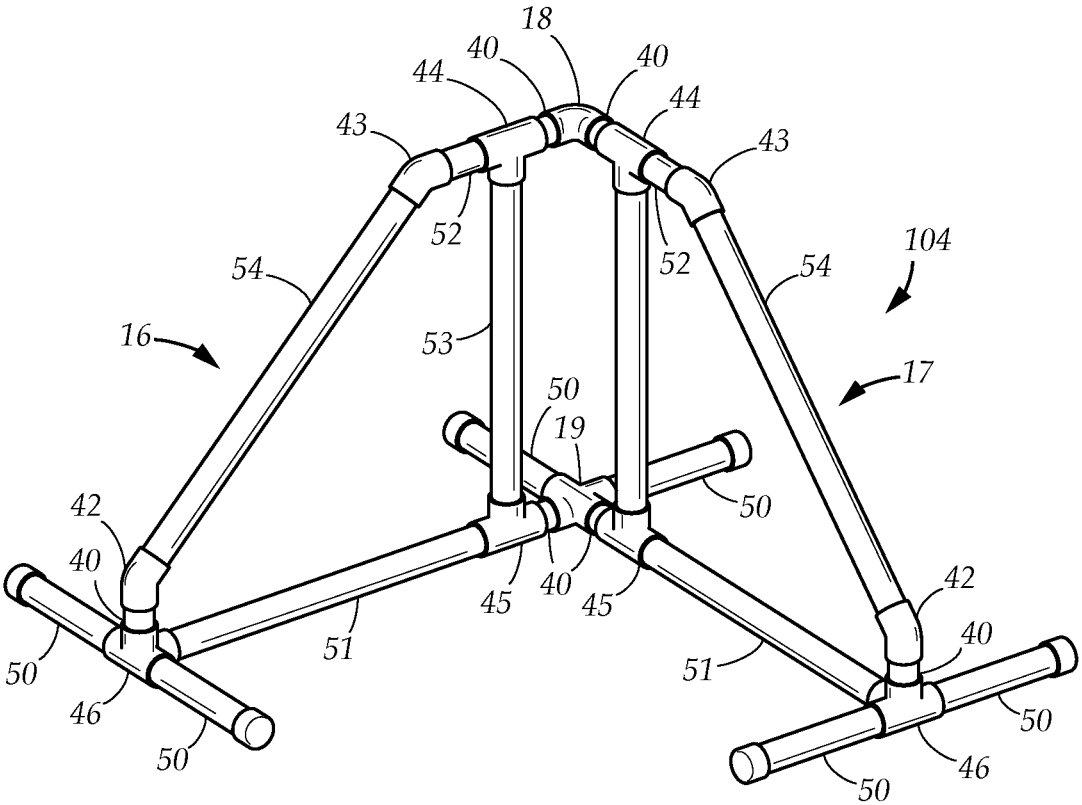
FIG. 2 is a front perspective view of an example embodiment of an elbow planche support.
Figure 3:
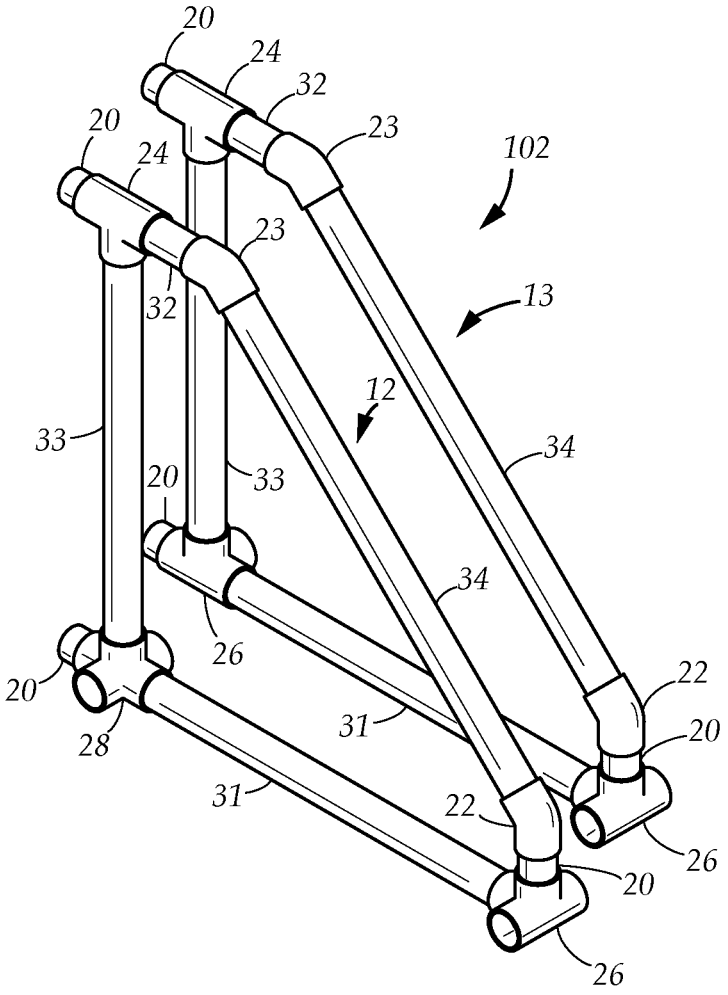
FIG. 3 is a perspective view of a pair of geometric structures prior to assembly of the elbow planche support.

Referring to FIG. 2, a second example embodiment of an elbow planche support 104 is shown. The elbow planche support 104 comprises two trapezoids 16, 17. The trapezoids 16, 17 connect with a 90-degree joint 18 and a cross elbow joint 19. Each trapezoid 16,17 comprises of a plurality of straight sections connected by a plurality of couplers 40, a plurality of angled joints 42, a plurality of T-joints 44, 45, a four-way joint 46, and a plurality of feet 50. In this example embodiment, the 90-degree joint is fixed at a right angle.

The cross elbow joint 19 has four connections at right angles to one another in the x- and y- planes. The T-joints 44, 45 have three connection points at right angles to one another in the x- and y-planes. The four-way joint 46 has three connection points at right angles to one another in the x- and y- planes, and one connection point in the z-plane the z-plane connection point being at a right angle to the x- and y-planes.

Referring to each trapezoid 16, 17, the long base 51 is connected to the second leg 54 with a four-way joint 46 connected to a first coupler 40 and a first angled joint 42. The second leg 54 is connected to the short base 52 with a second angled joint 43. The short base 52 is connected to the first leg 53 with a first T-joint 44, and the first leg 53 is connected to the long base 31 with a second T-joint 45.

The first T-joint 44 is connected to the 90-degree elbow joint 18 with a second coupler 40, second T-joint 45 is connected to the cross elbow joint 19 with a third coupler 40.

The pair of trapezoids 16, 17 are connected at the 90-degree elbow joint 18 and the cross elbow joint 19 with couplers 40. In the second embodiment, the unitary structure of the connected trapezoids 16, 17 comprises of six feet 50. Four of the six feet 50 are connected to the 4-way joints 46 of the pair of trapezoids 16,17 and two of the six feet 50 are connected to the cross elbow joint 19.

Referring to FIG. 2, each trapezoid 16, 17 may be fully or partially disassembled, having removable couplers 40 at the 90-degree joint 18 and the cross elbow joint 19 for ease of storage. Each individual joint previously described may be press-fit into one another, and each joint may be fully or partially disassembled. The preferred embodiment may be fully folded after removing the feet 50 and decoupling the couplers 40 at the 90-degree joint 18 and the cross elbow joint 19 for ease of storage. The embodiment may further comprise feet holders not shown, which may be used to store the feet 30 for ease of storage.

In a further example embodiment, the elbow planche support 104 may be fashioned into a unitary piece.

FIGS. 3-6 depict a method of assembly of the preferred embodiment of elbow planche support 102. The first and second trapezoids 12, 13 are first in a folded position for ease of storage. In the preferred embodiment, the articulating joints 14 not shown and the feet 30 are removable. The articulating joints 14 are removably press-fit into the couplers 20.

Figure 4:
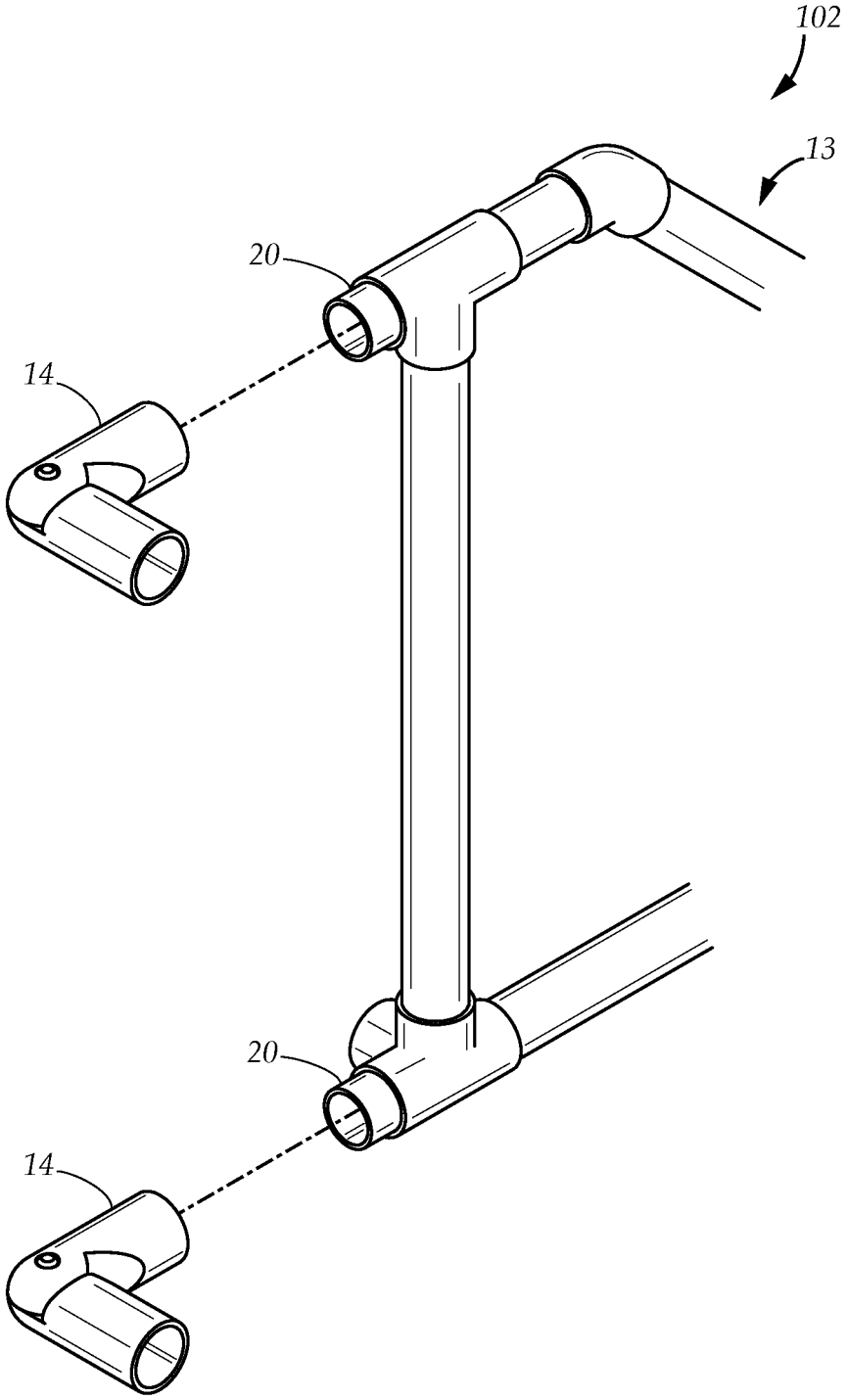
FIG. 4 is a perspective view of a step in the assembly of the elbow planche support.
Figure 5:
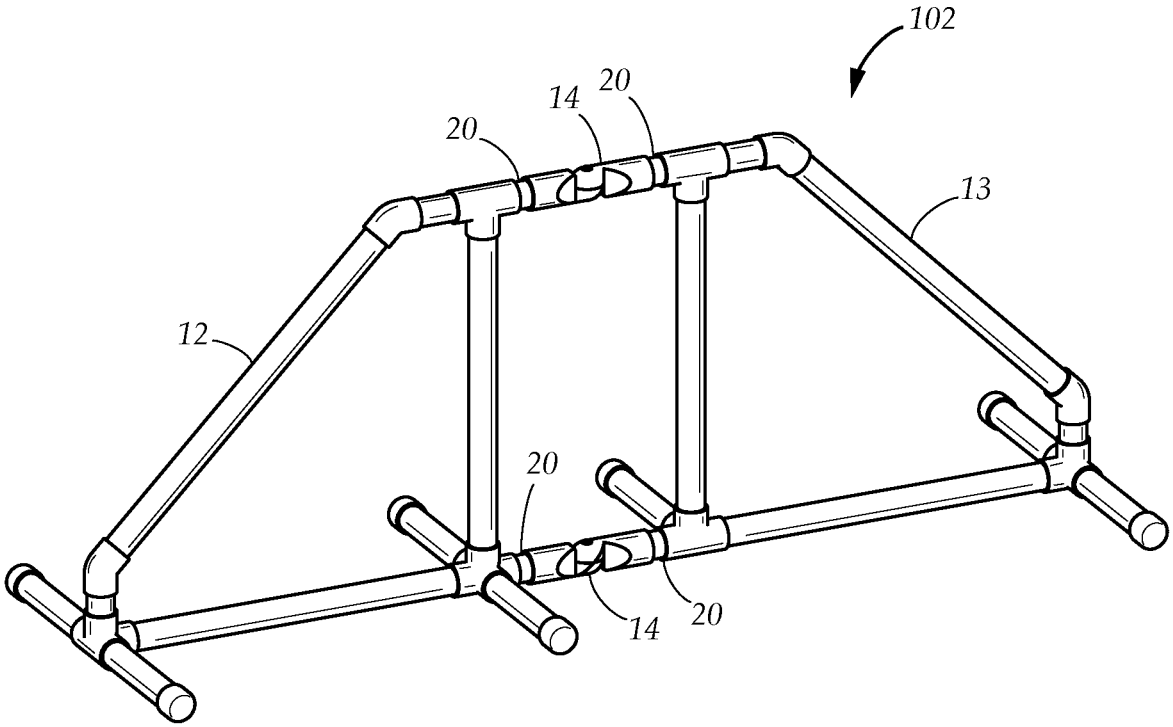
FIG. 5 is a perspective view of the pair of geometric structures joined together in a step in the assembly of the elbow planche support.
Figure 6:
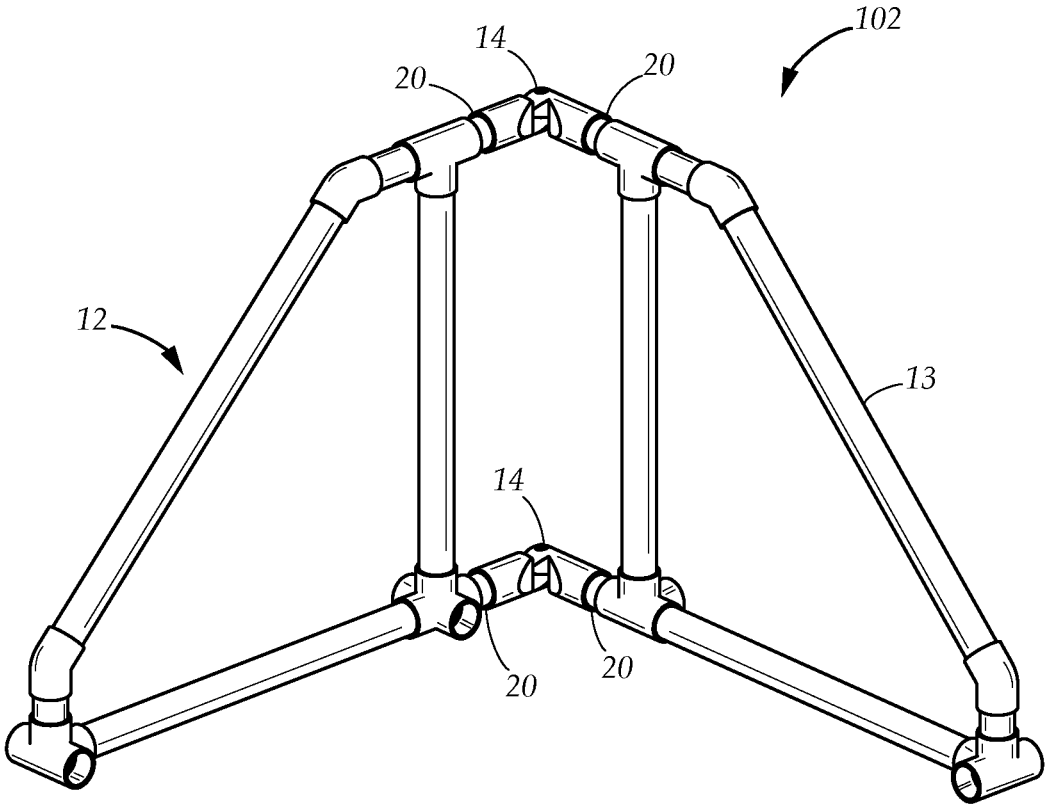
FIG. 6 is a perspective view of the joined geometric structures in position prior a plurality of feet is attached.

In FIG. 4, the user attaches the articulating joints 14 to either the couplers of the first or second trapezoids 12, 13. In FIG. 5, the user attaches the other trapezoid 12, 13 to the articulating joints 14. The user also attaches the feet 30 to their respective locations previously described. The user then folds the articulating joint 14 to create a right angle between the first and second trapezoids 12, 13. In the preferred embodiment, the second trapezoid only has three feet 30 as to not interfere with the fourth foot 30 of the first trapezoid 12 when the first and second trapezoid 12, 30 are at a right angle to each other. At a right angle, the elbow planche support is fully assembled and the user may perform exercises on the apparatus.

Figure 8:
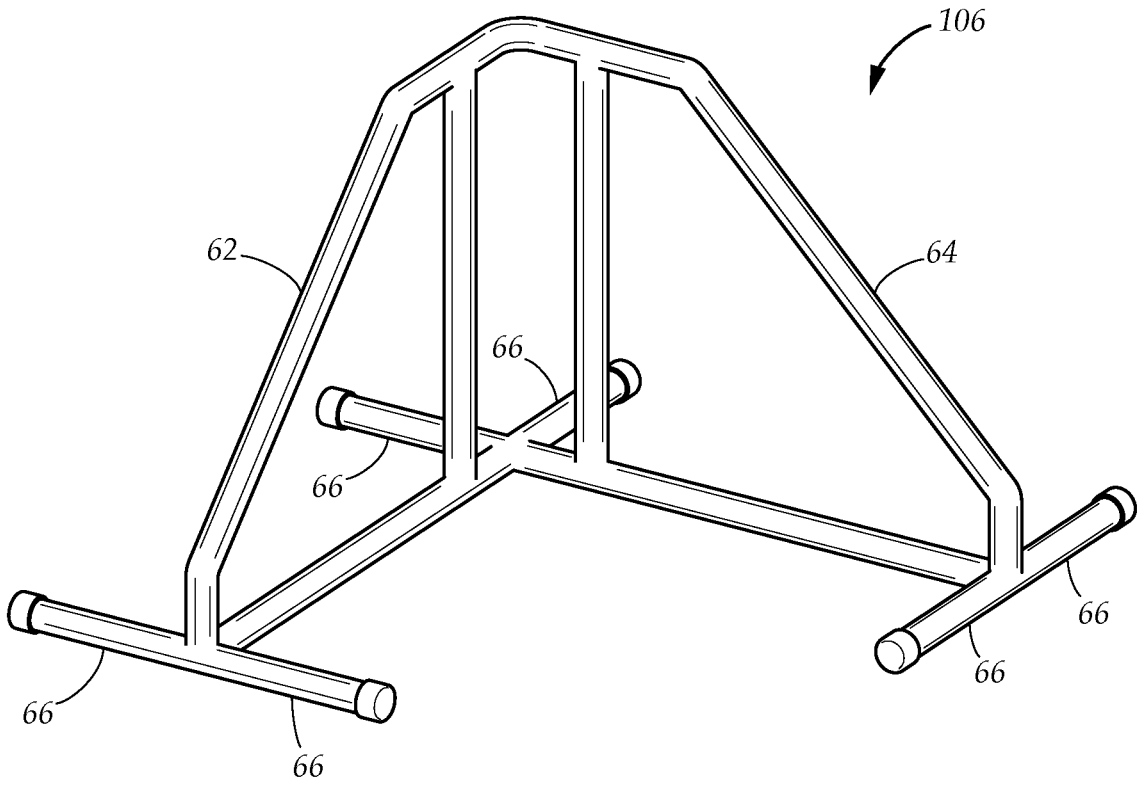
FIG. 8 is a front perspective view of another example embodiment of an elbow planche support.

Referring to FIG. 8, yet another embodiment is shown. An elbow planche support 106 is a unitary structure having two trapezoids 62, 64. The two trapezoids 62. 64 are at a right angle to each other. The elbow planche support 106 preferably has six feet 66.

Figure 9:
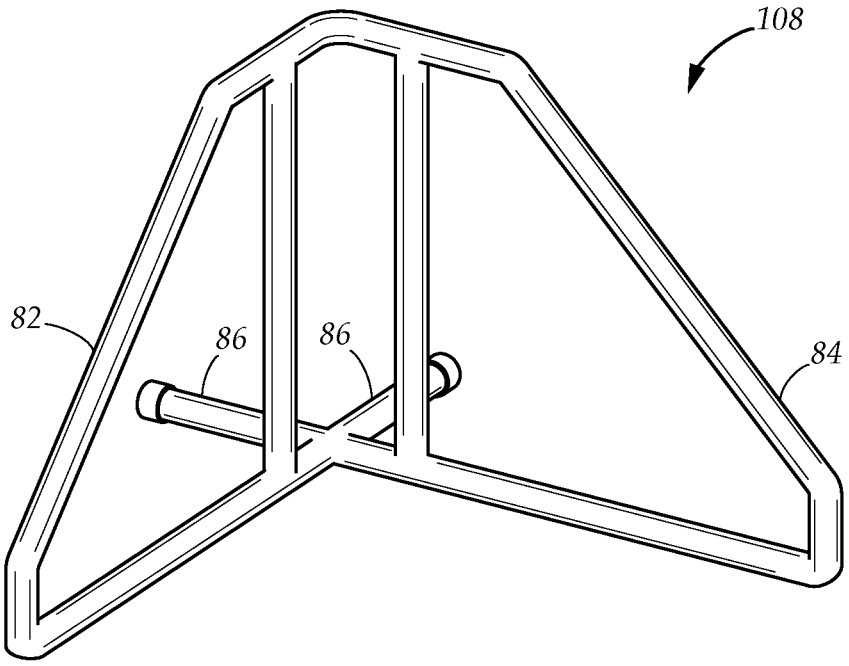
FIG. 9 is a front perspective view of a further example embodiment of an elbow planche support.

Referring to FIG. 9, yet another embodiment is shown. An elbow planche support 108 is a unitary structure having two trapezoids 82, 84. The two trapezoids 82. 84 are at a right angle to each other. The elbow planche support 108 preferably has two feet 86.

It is understood by those of ordinary skill in the art, that the several of the features shown in FIG. 1 can be interchanged with the similar features having the same function shown in FIG. 8 and FIG. 9 within the inventive concept.

The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an elbow planche support. The disclosure is illustrated by example in the drawing figures, and throughout the written description. It should be understood that numerous variations are possible, while adhering to the inventive concept. Such variations are contemplated as being a part of the present disclosure.

What is claimed is:

1. An elbow planche support, comprising:

a pair of trapezoidal geometrical supports each having a distal end, a first trapezoidal geometrical support and a second trapezoidal geometrical support, wherein the first trapezoidal geometrical support and the second trapezoidal geometrical support are each a right trapezoid, each trapezoidal geometrical support having a short top base, a long bottom base parallel to the short top base and a vertical leg orthogonal to the long bottom base; and a plurality of articulating elbow joints connecting the first geometrical support and the second geometrical support, the articulating elbow joints forming an angle between the first geometrical support and the second geometrical support, the articulating elbow joints rotating from a right angle such that the distal ends of the pair of trapezoidal geometrical supports separate and form a straight line from the distal end of the first trapezoidal geometrical support to the distal end of the second trapezoidal geometrical support.

2. The elbow planche support as described in claim 1, further comprising a plurality of feet connecting orthogonally to the long bottom bases of the trapezoidal geometrical supports.

3. The elbow planche support as described in claim 2, wherein the plurality of articulating elbow joints connects the first trapezoidal geometrical support and the second trapezoidal geometrical support at the short top bases of the pair of trapezoidal geometrical supports and at the long bottom bases of the pair of the trapezoidal geometrical supports.

4. The elbow planche support as described in claim 3, further comprising a plurality of couplers connecting the plurality of articulating elbow joints to the trapezoidal geometrical supports.

5. The elbow planche support as described in claim 4, wherein the elbow planche support is selectively assembled and disassembled and the feet, elbow joints and couplers are selectively removable.

6. The elbow planche support as described in claim 5, further comprising a plurality of feet holders on the trapezoids configured for storing the feet when the elbow planche support is selectively disassembled.

7. An elbow planche support, comprising:

a pair of trapezoidal supports each having a long bottom base, each long bottom base having a distal end, a first trapezoidal support and a second trapezoidal support;

a plurality of feet perpendicular to the first trapezoid support and the second trapezoid support; and a plurality of articulating elbow joints connecting the first trapezoidal support and the second trapezoidal support, the articulating elbow joints rotating from a right angle to a straight line, the straight line continuing from the distal end of the first trapezoidal support to the distal end of the second trapezoidal support when the elbow planche support is assembled.

8. The elbow planche support as described in claim 7, wherein the first trapezoidal support and the second trapezoidal support are each a right trapezoid, each trapezoid having a short top base and a vertical leg connecting the short top base to the long bottom base.

9. The elbow planche support as described in claim 8, wherein the plurality of articulating elbow joints connects the first trapezoidal support and the second trapezoidal support at the short top bases of the right trapezoids and at the long bottom bases of the right trapezoids.

10. The elbow planche support as described in claim 9, further comprising a plurality of couplers connecting the plurality of articulating elbow joints to the trapezoidal supports.

11. The elbow planche support as described in claim 10, wherein the elbow planche support is selectively assembled and disassembled, and the feet, the plurality of articulating elbow joints and couplers are selectively removable.

12. The elbow planche support as described in claim 11, further comprising a plurality of feet holders on the pair of trapezoidal supports configured for storing the feet when the elbow planche support is selectively disassembled.

* * * * *